US005614484A

United States Patent [19]

Panandiker

[11] Patent Number: 5,614,484

[45] Date of Patent: Mar. 25, 1997

[54] DETERGENT COMPOSITIONS CONTAINING LIPASE AND TERPENE

[75] Inventor: Rajan K. Panandiker, Cincinnati, Ohio

[73] Assignee: The Procter & Gamble Company, Cincinnati, Ohio

[21] Appl. No.: 303,280

[22] Filed: Sep. 8, 1994

Related U.S. Application Data

[63] Continuation of Ser. No. 41,282, Mar. 30, 1993, abandoned, which is a continuation of Ser. No. 748,153, Aug. 21, 1991, abandoned.

[51] Int. Cl.[6] ..... C11D 3/386; C11D 3/50

[52] U.S. Cl. ..... 510/102; 510/103; 510/104; 510/105; 510/106; 510/107; 510/320; 510/392

[58] Field of Search ..... 252/174.12, DIG. 12, 252/174.11, DIG. 1; 510/102–107, 320, 392

[56] References Cited

U.S. PATENT DOCUMENTS

| | | | |
|---|---|---|---|
| 3,761,420 | 9/1973 | Bogardus | 252/171 |
| 4,134,838 | 1/1979 | Hooper et al. | 252/528 |
| 4,289,641 | 9/1981 | Hooper et al. | 252/96 |
| 4,304,679 | 12/1981 | Hooper et al. | 252/106 |
| 4,322,308 | 3/1982 | Hooper et al. | 252/107 |
| 4,326,967 | 4/1982 | Melville | 252/8.8 |
| 4,515,705 | 5/1985 | Moeddel et al. | 252/174.12 |
| 4,663,068 | 5/1987 | Hagemann et al. | 252/8.8 |
| 4,711,739 | 12/1987 | Kandathill | 252/139 |
| 4,876,024 | 10/1989 | Enomoto et al. | 252/174.12 |
| 4,908,150 | 3/1990 | Hessel et al. | 252/174.12 |
| 4,923,631 | 5/1990 | Sims et al. | 252/186.42 |
| 4,992,198 | 2/1991 | Nebashi | 252/174.11 |
| 5,013,485 | 5/1991 | Tsukuda et al. | 252/551 |
| 5,025,069 | 6/1991 | Deguchi et al. | 252/174.17 |
| 5,089,162 | 2/1992 | Rapisarda | 252/102 |
| 5,143,900 | 1/1992 | Steltenkamp | 512/26 |
| 5,174,927 | 12/1992 | Honsa | 252/543 |

FOREIGN PATENT DOCUMENTS

| | | | |
|---|---|---|---|
| 91156413 | 9/1990 | Australia | 252/174.12 |
| 63198/90 | 11/1991 | Australia . | |
| 0218272 | 4/1987 | European Pat. Off. . | |
| 0331376 | 6/1989 | European Pat. Off. . | |
| 0385401 | 5/1990 | European Pat. Off. . | |
| 0368589 | 5/1990 | European Pat. Off. . | |
| 0376705 | 7/1990 | European Pat. Off. . | |
| 0381262 | 8/1990 | European Pat. Off. . | |
| 0430315 | 5/1991 | European Pat. Off. | 252/174.12 |
| 430315 | 6/1991 | European Pat. Off. . | |
| 0407225A1 | 9/1991 | European Pat. Off. . | |
| 57/085898 | of 1982 | Japan . | |
| 57/085900 | of 1982 | Japan . | |
| 58-117295 | of 1983 | Japan . | |
| 61/1575976 | of 1986 | Japan . | |
| 61/238900 | of 1986 | Japan . | |
| 61/085498 | of 1986 | Japan . | |
| 61/076599 | of 1986 | Japan . | |
| 61/014298 | of 1986 | Japan . | |
| 61/012798 | of 1986 | Japan . | |
| 61/014296 | of 1986 | Japan . | |
| 1/256596 | of 1989 | Japan . | |
| 1/182400 | of 1989 | Japan . | |
| 1/161096 | of 1989 | Japan . | |
| 1/161095 | of 1989 | Japan . | |
| 2178397 | 6/1990 | Japan | 252/174.12 |
| 2-178397 | 7/1990 | Japan . | |
| 1252180 | 11/1971 | United Kingdom . | |
| 1297569 | 11/1972 | United Kingdom . | |
| WO89/04361 | 5/1989 | WIPO . | |
| WO91/00908 | 1/1991 | WIPO . | |
| 9304158 | 3/1993 | WIPO . | |

OTHER PUBLICATIONS

CA –JP 01/182400 abstract.

"Reduction of Malodours," Research Disclosure, May, 1986, Havant Great Britain, p. 26554.

Organic Chemistry, Allinger et al, pp. 783–786 (1971), Worth Publishers Inc.

Encyclopedia of Chemical Technology, Kirk and Othmer, vol. 22, pp. 709–762 (1978), John Wiley & Sons.

Pending European Patent Application Serial No. 91/200149.2, filed Jan. 25, 1991.

*Primary Examiner*—Douglas J. McGinty
*Assistant Examiner*—Kery Fries
*Attorney, Agent, or Firm*—George W. Allen

[57] ABSTRACT

A detergent composition which comprises a lipase enzyme, a surfactant selected from the group consisting of anionic, nonionic, zwitterionic, amphoteric, and mixtures thereof and a specific perfume ingredient.

14 Claims, No Drawings

DETERGENT COMPOSITIONS CONTAINING LIPASE AND TERPENE

This is a continuation of abandoned application Ser. No. 08/041,282, filed Mar. 30, 1993, which is in turn a continuation of abandoned application Ser. No. 07/748,153, filed on Aug. 21, 1991.

TECHNICAL FIELD

This invention relates to laundry detergent compositions containing detersive surfactant, lipase, and terpene or terpenoid. More specifically, the compositions contain from about 0.005% to about 1% of terpene or terpenoid with a boiling point between about 120° C. and 229° C.

BACKGROUND OF THE INVENTION

It has been found that when clothes are washed in laundry detergents containing lipase, an unattractive odor resembling the odor of spit-up from babies can remain on the fabric afterward. It is believed that lipase, which is adsorbed on fabric stains in the wash cycle, continues to function in the rinse cycle and the dryer. Without meaning to be bound by theory, it is believed that this malodor is produced by the hydrolysis, which is catalyzed by lipase, of short chain triglycerides in some soils on the fabric. The hydrolysis produces free fatty acids (e.g. butyric acid) having a malodor. If the hydrolytic products are not completely removed during the wash or rinse cycles, the odor persists on dry fabrics, especially where there are dairy product stains. Experimental evidence shows that the intensity of odor peaks after about two days of storage of the dry garment.

It has been found that including a certain amount of terpene or terpenoid in the laundry detergent can markedly reduce or eliminate this malodor. Again without meaning to be bound by theory, it is believed that this combination of lipase and terpene is effective because terpenes boil at about the same temperature (about 120°–229° C.) as the malodorous compounds, so both vaporize at about the same time, resulting in the elimination or reduction of the unpleasant odor.

The inclusion of lipase in laundry detergent compositions is known and is of current interest in the detergent industry. For example, U.S. Pat. No. 4,908,150, Hessel et al, issued Mar. 13, 1990 describes liquid detergent compositions containing lipolytic enzymes wherein the stability of the lipolytic enzyme is said to be improved by the inclusion of particular nonionic ethylene glycol-containing copolymers.

Terpenes and terpenoids have been disclosed as perfume components in detergent compositions. For example, U.S. Pat. No. 4,515,705, Moeddel, issued May 7, 1985 describes compositions containing proteases having no detectable odor at a concentration of less than about 0.002 Anson units per gram of distilled water, and selected perfume materials which include some terpenes. The proteases therein are odor purified. The benefit of the perfumes therein is the reduction or elimination of the unpleasant odor contribution of protease stock.

Japanese Publication HEI2-178397, Watanabe et al., laid open Jul. 11, 1990, discloses detergent compositions containing anionic surfactant; alkaline lipase which has an activity at pH 9 which is at least 30% of that at pH 7; and fragrance component(s) with a boiling point above 230° C. which are 30% or more of the total fragrance composition: 0.05–1 weight %; and the ratio of the total sodium ion to potassium is within the range 4:1–1:4.

None of these publications teach or describe laundry detergent compositions comprising detersive surfactant, detergent-compatible lipase, and a certain amount of terpenes or terpenoids with a boiling point between about 120° C. and about 229° C.

SUMMARY

The present invention concerns laundry detergent compositions comprising:

(a) from about 0.0001 to about 1.0% on an active basis of a detergent-compatible lipase;

(b) from about 0.005% to about 1.0%, by weight of the composition, of a terpene or terpenoid with a boiling point between about 120° C. and 229° C.; and (c) from about 1 to about 95% of a detersive surfactant selected from the group consisting of anionic, nonionic, ampholytic, cationic, zwitterionic, and mixtures thereof.

DESCRIPTION OF THE INVENTION

The laundry detergent compositions herein comprise terpene or terpenoid with a boiling point between about 120° C. and 229° C.; detergent-compatible lipase; and a detersive surfactant selected from the group consisting of anionic, nonionic, ampholytic, cationic, zwitterionic, and mixtures thereof.

A. Terpenes

The laundry detergent compositions herein comprise from about 0.005 to about 1.0, more preferably about 0.01 to about 0.8, most preferably about 0.05 to about 0.4, weight % of terpenes or terpenoids. The terpenes or terpenoids have a boiling point between about 120° C. and about 229° C., more preferably between about 125° C. and about 225° C., most preferably between about 160° C. and about 200° C. Herein "terpene" includes terpenoids, which include derivatives such as alcohols, esters and aldehydes, and saturated and unsaturated isomers. Terpenes useful in this invention are described by Allinger et al. in *Organic Chemistry,* pages 783–786 (1971), Worth Publishers Inc., and in Kirk and Othmer's *Encyclopedia of Chemical Technology,* Vol. 22, pages 709–762 (1978), John Wiley & Sons, which are incorporated herein by reference.

"Terpenes are widely distributed in nature, and occur in nearly all living plants. They are generally regarded as derivatives of isoprene, wherein the isoprene units are arranged in a head-to-tail fashion, although there are some exceptions to this arrangement. The terpenes are therefore classified according to the number of isoprene units in their carbon skeletons, with a single terpene unit being regarded as two isoprene units." *Encyclopedia of Chemical Technology,* pg. 709.

Terpenes can be used in aroma and flavor chemicals, solvents in paints and varnishes, production intermediates for vitamins, etc. Terpenes can be acyclic (open chain), monocyclic (one ring), bicyclic (two rings), tricyclic (three rings), etc.

Both cyclic and acyclic terpenes and terpenoids are useful in this invention. Terpenes are classified as shown in Table 1 based on the number of isoprene units.

TABLE 1

| Classification of Terpenes | | |
|---|---|---|
| Isoprene units | Carbon atoms | Classification |
| 1 | 5 | hemiterpene |
| 2 | 10 | monoterpene |
| 3 | 15 | sesquiterpene |
| 4 | 20 | diterpene |
| 5 | 25 | sesterterpene |
| 6 | 30 | triterpene |
| 8 | 40 | tetraterpene |
| >8 | >40 | polyterpene |

*Encyclopedia of Chemical Technology,* pg. 709.

Terpenes and terpenoids which are particularly suited for this invention are monoterpenes and hemiterpenes, oxygenated monoterpenes, sesquiterpenes and their derivatives. Particularly preferred are the monoterpenes and oxygenated monoterpenes, which include the following.

Monoterpenes

αand β Pinene: These are derived from turpentine oil and isolated by steam distillation or vacuum fractionation. Both α and β pinene are useful as perfume ingredients and serve as intermediates in the manufacture of other terpenes.

Derivatives of α and β pinene and their derivatives are useful in the present invention.

Myrcene: Myrcene is prepared by thermal rearrangement/pyrolysis of β pinene. It is further purified by fractional distillation with a suitable inhibitor to prevent dimerization. It can be derivatized to form compounds such as geranyl acetate and geraniol. Myrcene can be hydrochlorinated to obtain a mixture of geranyl chloride and meryl chloride which are further converted to alcohols via their acetate esters. Both esters and alcohols have rosy, floral, fruity type odors.

p-Cymene and p-menthadiene: These are obtained as by-products from the manufacture of synthetic pine oil and camphene. They are also produced by acid treatment of α and β pinene. The most important menthadiene is d-limonene which is a by-product of the citrus industry. Pure and dl-limonene is used in fragrance and flavor compositions.

Commercially, most p-menthadienes are sold as mixtures called dipentene. Dipentene compositions vary according to the source but primarily contain a mixture of terpenes such terpinolene, α-terpinene, camphene, tricyclene, α pinene, p-cymene α and β phellandrene and α terpinene.

Other monoterpenes useful in this invention are camphene, 3 carene, allocimene, tricyclene and their derivative oxygenated monoterpenes.

Oxygenated Monoterpenes

Geraniol and nerol: These occur naturally in citronella oil and are separated by fractional distillation. They can also be manufactured synthetically. Derivatives of geraniol and nerol are also useful in the present invention.

Linanool can be isolated from bois de rose oil or produced synthetically as shown by Teisserie in the French Patent 1,132,659 dated Mar. 14, 1957.

Dihyrolinanool is also produced synthetically as has been described by Kimel et al., *Journal of Organic Chemistry,* 22 1611 (1967) and by Lindlar in *Helv. Chim Acta* 35 446 (1952) and in U.S. Pat. No. 3,674,888, issued Jul. 2, 1972. The dihydrolinalool is then hydrogenated to linalool. Preparation of similar monoterpenes from isobutylene and formaldehyde has been reported by Pommer et al. in German Patent 259,876, dated Feb. 1, 1968. Dihydrolinalool is used as a starting material to prepare derivatives such as pseudoionone. The method for preparation of this derivative has been described in Kirk and Othmer's *Encyclopedia of Chemical Technology,* Vol. 22, pp. 732–733. Linalool, dihydrolinalool and their derivatives are useful in fragrance compositions.

Citral: Citral, which is historically derived from lemon grass oil, is currently produced from myrcene. The method of manufacture has been described by Monotavon in U.S. Pat. No. 2,902,515, published on Sep. 1, 1959.

Ionone and Methyl Ionone: Ionones such as α-ionone, β-ionone and methyl ionones are generally manufactured from citral. Ionones are used extensively in perfumery with the α isomers being most valuable.

Citronellol and citronellal: These are found in nature in citronella oil and eucalyptus citridora, but they are generally manufactured from α and β pinene on a commercial scale by conversion of pinene to geraniol-nerol, followed by rearrangement. Hydroxy citronellal and alkoxy citronellal, in particular methoxy citronellal, are also useful terpenoid derivatives. Hydroxy citronellal is valued for its lily-of-the-valley fragrance whereas citronellol has a natural rosy scent.

Myrcenol and dihydromyrcenol: These are also members of the terpene family. They are produced from myrcene and are usually used as esters in perfumery because of the lack of stability of the parent compound.

Other useful oxygenated monoterpene derivatives have been described in Kirk and Othmer's *Encyclopedia of Chemical Technology,* (1978) Vol. 22, pp. 730–749.

Pine oil is an important source of monoterpenes and their oxygenated derivatives. The most predominant are α terpineol, 2 terpineol, β terpineol, α fenchol, borneol, isoborneol, camphor, terpinen-1-ol, terpin-4-l, dihydroterpineol, methyl chavicol, anethole, 1,4 and 1,8 cineole. Not all of these compounds are present in all pine oils, but all pine oils contain α terpineol as the main oxygenated component. In addition, pine oil also contains p-mentadienes such as limonene, terpinoline, α terpinene, pinene, cynrene and γ terpinene. Many grades of pine oil are commercially available and differ according to the source, efficiency and type of distillation.

Monoterpenes are also made from turpentine. Wood turpentine is commonly used in the manufacture of dipentine, camphene and terpineol. Typically, turpentine contains 60–70 weight % of α pinene, 20–30% β pinene, and other components. β-pinene is used in the manufacture of geraniol, nerol and linalool.

Terpenes and terpenoids are also manufactured synthetically using an acetylene-acetone route. See Kirk and Othmer's *Encyclopedia of Chemical Technology* Vol. 22, pp. 714 (1978).

Sesquiterpenes

Sesquiterpene hydrocarbons contain 15 carbon atoms and are usually comprised of 3 isoprene units. Sesquiterpenes can be acyclic, monocyclic, bicyclic, tricyclic, or tetracyclic. Their structures can be simple or complex. Some of the common sesquiterpenes are (see *Encyclopedia of Chemical Technology,* page 751):

| Terpene | Source |
|---|---|
| cedrol | cedarwood oil |
| α santalol | sandlewood oil |
| β santalol | sandlewood oil |
| patchouli alcohol | patchouli |
| guaiol | guaiac wood |
| α cedrene | cedarwood |
| caryophyllene | clove |

A majority of sesquiterpenes are produced from natural sources. Isolation is accomplished by extraction, fractionation and crystallization. These terpenes and their derivatives, particularly acetyl derivatives, are useful perfume components.

TABLE 2

Boiling Points of Preferred Terpenes at Normal Pressure

| | Boiling Point °C. |
|---|---|
| α Terpineol | 168 |
| Citronellol | 206 |
| Isobornyl acetate | 227 |
| Linalool | 198 |
| Linalyl acetate | 220 |
| Camphene | 159 |
| α-pinene | 156 |
| β-pinene | 165 |
| Citral | 214 |
| Dipentene | 178 |
| Geranyl nitrile | 222 |
| D-limonene | 175 |
| Myrcene | 167 |
| Dihydromyrcenol | 172 |
| p cymene | 177 |
| α-fenchol | 193 |
| nerol | 227 |

From Arctander, *Perfume and Flavor Chemicals* Vol. I and II (1969), published by the author. The most preferred terpenes are citronellol, limonene, linalool, myrcene, dihydromyrcenol, α-fenchol, nerol, and mixtures thereof. Mixtures are most preferred.

It is preferred that the terpenes herein be mixed together prior to addition to the laundry detergent composition. The terpenes may be combined with other perfume ingredients before addition to the composition, so long as the level of terpenes in the final detergent composition is at least 0.005 weight %.

The terpene-containing perfume is preferably sprayed onto the final granular detergent composition or mixed into the final liquid laundry detergent in a manner which does not adversely affect the perfume. Granular compositions preferably contain about 0.1 to about 0.7 weight % of perfume, which can be up to 100% terpenes, and liquid compositions preferably contain about 0.1 to 0.4 weight % of perfume, which again can be up to 100% terpenes.

B. Lipase

A second essential ingredient in the present laundry detergent compositions is a performance-enhancing amount, preferably from about 0.0001 to 1.0% on an active basis, of a detergent-compatible lipase (lipolytic enzyme). By "detergent-compatible" is meant compatibility with the other ingredients of the composition, particularly detergent surfactants and any detergency builders. Liquid detergent compositions, particularly heavy duty liquids, are preferred herein.

Any lipase suitable for use in a laundry detergent composition can be used herein. Suitable lipases for use herein include those of bacterial and fungal origin. Lipase from chemically or genetically modified mutants are included herein.

Suitable bacterial lipases include those produced by Pseudomonas, such as *Pseudomonas stutzeri* ATCC 19.154, as disclosed in British Patent 1,372,034, incorporated herein by reference. Suitable lipases include those which show a positive immunological cross-reaction with the antibody of the lipase produced by the microorganism *Pseudomonas fluorescens* IAM 1057. This lipase and a method for its purification have been described in Japanese Patent Application 53-20487, laid open on Feb. 24, 1978, which is incorporated herein by reference. This lipase is available under the trade name Lipase P "Amano," hereinafter referred to as "Amano-P." Such lipases should show a positive immunological cross reaction with the Amano-P antibody, using the standard and well-known immunodiffusion procedure according to Ouchterlony (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Psuedomonas nitroreducens* var. lipolyticum FERM P 1338 (available under the trade name Amano-CES), lipases ex *Chromobacter viscosum,* e.g. *Chromobacter viscosum* var. lipolyticum NRRLB 3673, and further *Chromobacter viscosum* lipases, and lipases ex *Pseudomonas gladioli.* Other lipases of interest are Amano AKG and Bacillis Sp lipase.

Suitable fungal lipases include those producible by *Humicola lanuginosa* and *Thermomyces lanuginosus.* Most preferred is lipase obtained by cloning the gene from *Humicola lanuginosa* and expressing the gene in *Aspergillus oryzae* as described in European Patent Application 0 258 068, incorporated herein by reference, commercially available under the trade name Lipolase®.

From about 2 to about 20,000, preferably about 10 to about 6,000, lipase units per gram (LU/g) of lipase can be used in these compositions. A lipase unit is that amount of lipase which produces 1 μmol of titratable butyric acid per minute in a pH stat, where pH is 7.0, temperature is 30° C., and substrate is an emulsion of tributyrin, and gum arabic, in the presence of $Ca^{++}$ and NaCl in phosphate buffer.

C. Surfactant

The third essential ingredient in the present detergent compositions is from about 1% to about 95% of a detersive surfactant selected from the group consisting of anionic, nonionic, ampholytic, cationic, zwitterionic, and mixtures thereof. These are described, for example, in U.S. Pat. No. 4,318,818, Letton et al., issued Mar. 9, 1982, which is incorporated herein by reference.

From about 5 to about 50, more preferably about 10 to 30, weight % of detersive surfactant is preferred. Anionic or nonionic surfactant or mixtures thereof are preferred. Also preferred is a ratio of anionic:nonionic surfactant from about 1:2 to about 6:1.

Anionic Surfactant

Anionic surfactants useful for detersive purposes are included in the compositions hereof. These can include salts ( including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British Patent Specification No. 1,082,179, alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, fatty acid amides of methyl tauride, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO^-M^+$ wherein R is a $C_8$–$C_{22}$ alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

One type of anionic surfactant preferred for liquid detergent compositions herein is alkyl ester sulfonates. These are desirable because they can be made with renewable, non-petroleum resources. Preparation of the alkyl ester sulfonate surfactant component is according to known methods disclosed in the technical iterature. For instance, linear esters of $C_8$–$C_{20}$ carboxylic acids can be sulfonated with gaseous $SO_3$ according to "The Journal of the American Oil Chemists Society," 52 (1975), pp. 323–329. Suitable starting materials would include natural fatty substances as derived from tallow, palm, and coconut oils, etc.

The preferred alkyl ester sulfonate surfactant, especially for laundry applications, comprises alkyl ester sulfonate surfactants of the structural formula:

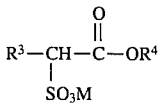

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a soluble salt-forming cation. Suitable salts include metal salts such as sodium, potassium, and lithium salts, and substituted or unsubstituted ammonium salts, such as methyl-, dimethyl, -trimethyl, and quaternary ammonium cations, e.g. tetramethyl -ammonium and dimethyl piperydinium, and cations derived from alkanolamines, e.g. monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{14}$–$C_{16}$ alkyl.

Alkyl sulfate surfactants are another type of anionic surfactant of importance for use herein. In addition to providing excellent overall cleaning ability when used in combination with polyhydroxy fatty acid amides (see below), including good grease/oil cleaning over a wide range of temperatures, wash concentrations, and wash times, dissolution of alkyl sulfates can be obtained, as well as improved formulability in liquid detergent formulations are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), substituted or unsubstituted ammonium cations such as methyl-, dimethyl-, and trimethyl ammonium and quaternary ammonium cations, e.g., tetramethyl -ammonium and dimethyl piperdinium, and cations derived from alkanolamines such as ethanolamine, diethanolamine, triethanolamine, and mixtures thereof, and the like. Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Alkyl alkoxylated sulfate surfactants are another category of useful anionic surfactant. These surfactants are water soluble salts or acids typically of the formula $RO(A)mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl -, dimethyl-, trimethylammonium and quaternary ammonium cations, such as tetramethyl-ammonium, dimethyl piperydinium and cations derived from alkanolamines, e.g. monoethanolamine, diethanolamine, and triethanolamine, and mixtures thereof. Exemplary surfactants are $C_{12}$–$C_{18}$ alkyl polyethoxylate (1.0) sulfate, $C_{12}$–$C_{18}$ alkyl polyethoxylate (2.25) sulfate, $C_{12}$–$C_{18}$ alkyl polyethoxylate (3.0) sulfate, and $C_{12}$–$C_{18}$ alkyl polyethoxylate (4.0) sulfate wherein M is conveniently selected from sodium and potassium.

Preferred for use in liquid detergent compositions herein are $C_{12}$–$C_{20}$ alkyl sulfate, $C_{12}$–$C_{20}$ alkyl ether sulfate and/or $C_9$–$C_{20}$ linear alkylbenzene sulfonate (preferably sodium salts). Preferably the nonionic surfactant is the condensation product of $C_{10}$–$C_{20}$ alcohol and between about 2 and 20 moles of ethylene oxide per mole of alcohol or polyhydroxy $C_{10-20}$ fatty acid amide.

Nonionic Surfactant

Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants are listed below.

1. The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol.

Commercially available nonionic surfactants of this type include Igepal™ CO-630, marketed by the GAF Corporation; and Triton™ X-45, X-114, X-100, and X-102, all marketed by the Rohm & Haas Company. These compounds are commonly referred to as alkyl phenol alkoxylates, (e.g., alkyl phenol ethoxylates).

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include Tergitol™ 15-S-9 (the condensation product of $C_{11}$–$C_{15}$ linear secondary alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-6.5 (the condensation product of $C_{12}$–$C_{13}$ linear alcohol with 6.5 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide), marketed by Shell Chemical Company, and Kyro™ EOB (the condensation product of $C_{13}$–$C_{15}$ alcohol with 9 moles ethylene oxide), marketed by The Procter & Gamble Company. This category of nonionic surfactant is referred to generally as "alkyl ethoxylates."

3. The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic™ surfactants, marketed by BASF.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

5. Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula $$R^3(OR^4)_xN(\overset{O}{\overset{|}{}}R^5)_2$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

6. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkylene-oxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexalo glucosides.

The preferred alkylpolyglycosides have the formula $$R^2O(C_nH_{2n}O)_t(\text{glycosyl})_x$$

wherein $R^2$ is selected from the group consisting of alkyl, alkyl-phenyl, hydroxyal kyl, hydroxyalkyl phenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4-and/or 6-position, preferably predominately the 2-position.

7. Fatty acid amide surfactants having the formula:

$$R^6-\overset{\overset{\displaystyle O}{\|}}{C}-N(R^7)_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C_2H_4O)_xH$ where x varies from about 1 to about 3.

Preferred amides are $C_8$–$C_{20}$ ammonia amides, monoethanolamides, diethanolamides, and isopropanolamides.

Polyhydroxy Fatty Acid Amide Nonionic Surfactant

The liquid detergent compositions hereof preferably contain an "enzyme performance-enhancing amount" of polyhydroxy fatty acid amide surfactant. By "enzyme-enhancing" is meant that the formulator of the composition can select an amount of polyhydroxy fatty acid amide to be incorporated into the composition that will improve enzyme cleaning performance of the detergent composition. In general, for conventional levels of enzyme, the incorporation of about 1%, by weight, polyhydroxy fatty acid amide will enhance enzyme performance.

The detergent compositions hereof will typically comprise at least about 1 weight % polyhydroxy fatty acid amide surfactant and preferably will comprise from about 3% to about 50%, most preferably from about 3% to about 30%, of the polyhydroxy fatty acid amide.

The polyhydroxy fatty acid amide surfactant component comprises compounds of the structural formula:

$$R^2-\overset{\overset{\displaystyle O}{\|}}{C}-\overset{\overset{\displaystyle R^1}{|}}{N}-Z \qquad \text{(I)}$$

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. Z preferably will be selected from the group consisting of $-CH_2-(CHOH)_n-CH_2OH$, $-CH(CH_2OH)-(CHOH)_{n-1}-CH_2OH$, $-CH_2-(CHOH)_2(CHOR')(CHOH)-CH_2OH$, and alkoxylated derivatives thereof, where n is an integer from 3 to 5, inclusive, and R' is H or a cyclic or aliphatic monosaccharide. Most preferred are glycityls wherein n is 4, particularly $-CH_2-(CHOH)_4-CH_2OH$.

Cationic Surfactant

Cationic detersive surfactants can also be included in detergent compositions of the present invention. Cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$ is selected from the group consisting of $-CH_2CH_2-$, $-CH_2CH(CH_3)-$, $-CH_2CH(CH_2OH)-$, $-CH_2CH_2CH_2-$, and mixtures thereof; each $R^4$ is selected from the group consisting of $C_1$–$C_4$ alkyl, $C_1$–$C_4$ hydroxyalkyl, benzyl, ring structures formed by joining the two $R^4$ groups, $-CH_2CHOH-CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, incorporated herein by reference.

Other Surfactants

Ampholytic surfactants can be incorporated into the detergent compositions hereof. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 (herein incorporated by reference) for examples of ampholytic surfactants.

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48 (herein incorporated by reference) for examples of zwitterionic surfactants.

D. Optional Ingredients

Second Enzymes

Optional, and preferred, ingredients include second enzymes, which include protease, amylase, peroxidase, cellulase, and mixtures thereof. By "second enzyme" is meant enzymes in addition to lipase which are also added to the composition. Second enzymes from chemically or genetically modified mutants, and from bacterial or fungal origin, are included herein.

The amount of second enzyme used in the composition varies according to the type of enzyme and the use intended. In general, from about 0.0001 to 1.0, more preferably 0.001 to 0.5, weight % on an active basis of these second enzymes are preferably used. Mixtures of enzymes from the same class (e.g. protease) or two or more classes (e.g. cellulase and protease) may be used.

Purified or non-purified forms of the enzyme may be used. It is not necessary to purify the enzyme stocks for use herein, particularly protease, prior to incorporation into the finished composition. The protease (proteolytic enzyme) herein preferably does not have "no detectable odor at a concentration of less than about 0.002 Anson units per gram of distilled water", as is required by U.S. Pat. No. 4,515,705, Moeddel, which is discussed above. The perfumes herein need not include any of the non-terpene perfume materials listed in U.S. Pat. No. 4,515,705 (see Col. 3, lines 9–37), which is incorporated herein by reference.

Any cellulase suitable for use in a detergent composition can be used in these compositions. From about 0.0001 to 1.0, preferably 0.001 to 0.5, weight % on an active enzyme basis of cellulase can be used.

Suitable cellulases are disclosed in U.S. Pat. No. 4,435,307, Barbesgaard et al., issued Mar. 6, 1984, incorporated herein by reference, which discloses fungal cellulase produced from *Humicola insolens*. Suitable cellulases are also disclosed in GB-A-2.075.028, GB-A-2.095.275 and DE-OS-2.247.832.

Examples of such cellulases are cellulases produced by a strain of *Humicola insolens* (*Humicola grisea* var. thermoidea), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (Dolabella Auricula Solander).

Any amylase suitable for use in a detergent composition can be used in these compositions. Amylases include, for example, α-amylases obtained from a special strain of *B. licheniforms*, described in more detail in British Patent Specification No. 1,296,839. Amylolytic proteins include, for example, Rapidase™, Maxamyl™ and Termamyl™.

From about 0.0001% to 1.0, preferably 0.0005 to 0.5, weight % on an active enzyme basis of amylase can be used.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro-and bromo-peroxidase. Peroxidase-containing detergent compositions are disclosed, for example, in PCT International Application WO 89/099813, published Oct. 19, 1989, by O. Kirk, assigned to Novo Industries A/S, incorporated herein by reference.

From about 0.0001 to 1.0, preferably about 0.0005 to 0.5, most preferably about 0.002 to 0.1,% on an active enzyme basis of detergent-compatible protease is preferred for use herein. Mixtures of proteases enzyme are also included. The protease can be of animal, vegetable or microorganism (preferred) origin. More preferred is serine protease enzyme of bacterial origin. Purified or nonpurified forms of this enzyme may be used. Proteases produced by chemically or genetically modified mutants are included by definition, as are close structural enzyme variants. Particularly preferred is bacterial serine protease enzyme obtained from *Bacillus subtilis* and/or *Bacillus licheniformis*.

Suitable proteases include Alcalase®, Esperase®, Savinase® (preferred); Maxatase®, Maxacal® (preferred), and Maxapem 15® (protein engineered Maxacal®); and subtilisin BPN and BPN' (preferred); which are commercially available. Preferred proteases are also modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. Preferred proteolytic enzymes, then, are selected from the group consisting of Savinase®, Maxacal®, BPN', Protease A, Protease B, and mixtures thereof. Protease B is most preferred.

Detergency Builders

From about 1 to about 80, preferably about 5 to about 60, more preferably about 10 to about 30, weight % of detergency builder can optionally be included herein. Inorganic as well as organic builders can be used. Preferred builders are those which are capable of sequestering $Ca^{+2}$ and $Mg^{+2}$.

Inorganic detergency builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. Borate builders, as well as builders containing borate-forming materials that can produce borate under detergent storage or wash conditions (hereinafter, collectively "borate builders"), can also be used. Preferably, non-borate builders are used in the compositions of the invention intended for use at wash conditions less than about 50° C., especially less than about 40° C.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck, incorporated herein by reference. However, other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates, including sodium carbonate and sesquicarbonate and mixtures thereof with ultra-fine calcium carbonate as disclosed in German Patent Application No. 2,321,001 published on Nov. 15, 1973, the disclosure of which is incorporated herein by reference.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2 \cdot ySiO_2)$$

wherein M is sodium, potassium, ammonium or substituted ammonium, z is from about 0.5 to about 2; and y is 1; this material having a magnesium ion exchange capacity of at least about 50 milligram equivalents of $CaCO_3$ hardness per gram of anhydrous aluminosilicate. Preferred aluminosilicates are zeolite builders which have the formula:

$$Na_z[(AlO_2)_z(SiO_2)_y]\cdot xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al., issued Oct. 12, 1976, incorporated herein by reference. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula:

$$Na_{12}[(AlO_2)_{12}(SiO_2)_{12}]\cdot xH_2O$$

wherein x is from about 20 to about 30, especially about 27. This material is known as Zeolite A. Preferably, the aluminosilicate has a particle size of about 0.1–10 microns in diameter.

Specific examples of polyphosphates are the alkali metal tripolyphosphates, sodium, potassium and ammonium pyrophosphate, sodium and potassium and ammonium pyrophosphate, sodium and potassium orthophosphate, sodium polymeta phosphate in which the degree of polymerization ranges from about 6 to about 21, and salts of phytic acid.

Examples of phosphonate builder salts are the water-soluble salts of ethane 1-hydroxy-1, 1-diphosphonate particularly the sodium and potassium salts, the water-soluble salts of methylene diphosphonic acid e.g. the trisodium and tripotassium salts and the water-soluble salts of substituted methylene diphosphonic acids, such as the trisodium and tripotassium ethylidene, isopyropylidene benzylmethylidene and halo methylidene phosphonates. Phosphonate builder salts of the aforementioned types are disclosed in U.S. Pat. Nos. 3,159,581 and 3,213,030 issued Dec. 1, 1964 and Oct. 19, 1965, to Diehl; U.S. Pat. No. 3,422,021 issued Jan. 14, 1969, to Roy; and U.S. Pat. Nos. 3,400,148 and 3,422,137 issued Sep. 3, 1968, and Jan. 14, 1969 to Quimby, said disclosures being incorporated herein by reference.

Organic detergent builders preferred for the purposes of the present invention include a wide variety of polycarboxylate compounds. As used herein, "polycarboxylate" refers to compounds having a plurality of carboxylate groups, preferably at least 3 carboxylates.

Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates. A number of ether polycarboxylates have been disclosed for use as detergent builders. Examples of useful ether polycarboxylates include oxydisuccinate, as disclosed in Berg, U.S. Pat. No. 3,128,287, issued Apr. 7, 1964, and Lambertl et al., U.S. Pat. No. 3,635,830, issued Jan. 18, 1972, both of which are incorporated herein by reference.

A specific type of ether polycarboxylates useful as builders in the present invention also include those having the general formula:

$$CH(A)(COOX)—CH(COOX)—O—CH(COOX)—CH(COOX)(B)$$

wherein A is H or OH; B is H or —O—CH(COOX)—$CH_2$(COOX); and X is H or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is —O—CH(COOX)—$CH_2$(COOX), then the compound is tartrate disuccinic acid (TDS) and its water-soluble salts. Mixtures of these builders are especially preferred for use herein. Particularly preferred are mixtures of TMS and TDS in a weight ratio of TMS to TDS of from about 97:3 to about 20:80. These builders are disclosed in U.S. Pat. No. 4,663,071, issued to Bush et al., on May 5, 1987.

Suitable ether polycarboxylates also include cyclic compounds, particularly alicyclic compounds, such as those described in U.S. Pat. Nos. 3,923,679; 3,835,163; 4,158,635; 4,120,874 and 4,102,903, all of which are incorporated herein by reference.

Other useful detergency builders include the ether hydroxypolycarboxylates represented by the structure:

$$HO—[C(R)(COOM)—C(R)(COOM)—O]_n—H$$

wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl (preferably R is hydrogen).

Still other ether polycarboxylates include copolymers of maleic anhydride with ethylene or vinyl methyl ether, 1, 3, 5-trihydroxy benzene-2,4,6-trisulphonic acid, and carboxymethyloxysuccinic acid.

Organic polycarboxylate builders also include the various alkali metal, ammonium and substituted ammonium salts of polyacetic acids. Examples include the sodium, potassium, lithium, ammonium and substituted ammonium salts of ethylenediamine tetraacetic acid, and nitrilotriacetic acid.

Also included are polycarboxylates such as mellitic acid, succinic acid, oxydisuccinic acid, polymaleic acid, benzene 1,3,5-tricarboxylic acid, and carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations, but can also be used in granular compositions.

Other carboxylate builders include the carboxylated carbohydrates disclosed in U.S. Pat. No. 3,723,322, Diehl, issued Mar. 28, 1973, incorporated herein by reference.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986, incorporated herein by reference. Useful succinic acid builders include the $C_5$–$C_{20}$ alkyl succinic acids and salts thereof. A particularly preferred compound of this type is dodecenylsuccinic acid. Alkyl succinic acids typically are of the general formula R—CH(COOH)$CH_2$(COOH) i.e., derivatives of succinic acid, wherein R is hydrocarbon, e.g., $C_{10}$–$C_{20}$ alkyl or alkenyl, preferably $C_{12}$–$C_{16}$ or wherein R may be substituted with hydroxyl, sulfo, sulfoxy or sulfone substituents, all as described in the above-mentioned patents.

The succinate builders are preferably used in the form of their water-soluble salts, including the sodium, potassium, ammonium and alkanolammonium salts.

Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Examples of useful builders also include sodium and potassium carboxymethyloxymalonate, carboxymethyloxysuccinate, cis-cyclo-hexane-hexacarboxylate, cis-cyclopentane-tetracarboxylate, water-soluble polyacrylates (these polyacrylates having molecular weights to above about 2,000 can also be effecitvly utilized as dispersants), and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Polycarboxylate builders are also disclosed in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other organic builders known in the art can also be used. For example, monocarboxylic acids, and soluble salts thereof, having long chain hydrocarbyls can be utilized. These would include materials generally referred to as "soaps." Chain lengths of $C_{10}$–$C_{20}$ are typically utilized. The hydrocarbyls can be saturated or unsaturated.

Soil-Release Agent

Any soil release agents known to those skilled in the art can be employed in the practice of this invention. Preferred polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

Useful soil release polymers are described in U.S. Pat. No. 4,000,093, issued Dec. 28, 1976 to Nicol et al., European Patent Application 0 219 048, published Apr. 22, 1987 by Kud et al. U.S. Pat. No. 3,959,230 to Hays, issued May 25, 1976, U.S. Pat. No. 3,893,929 to Basadur issued Jul. 8, 1975, U.S. Pat. No. 4,702,857, issued Oct. 27, 1987 to Gosselink, U.S. Pat. No. 4,711,730, issued Dec. 8, 1987 to Gosselink et al., U.S. Pat. No. 4,721,580, issued Jan. 26, 1988 to Gosselink, U.S. Pat. No. 4,702,857, issued Oct. 27, 1987 to Gosselink, U.S. Pat. 4,877,896, issued Oct. 31, 1989 to Maldonado et al. All of these patents are incorporated herein by reference.

If utilized, soil release agents will generally comprise from about 0.01% to about 10.0%, by weight, of the detergent compositions herein, typically from about 0.1% to about 5%, preferably from about 0.2% to about 3.0%.

Cheltaing Agents

The detergent compositions herein may also optionally contain one or more iron and manganese chelating agents as a builder adjunct material. Such chelating agents can be selected from the group consisting of amino carboxylates, amino phosphonates, polyfunctionally-substituted aromatic chelating agents and mixtures thereof, all as hereinafter defined. Without intending to be bound by theory, it is believed that the benefit of these materials is due in part to their exceptional ability to remove iron and manganese ions from washing solutions by formation of soluble chelates.

If utilized, these chelating agents will generally comprise is from about 0.1% to about 10% by weight of the detergent compositions herein. More preferably chelating agents will comprise from about 0.1% to about 3.0% by weight of such compositions.

Clay Soil Removal/Anti-redeposition Agent

The compositions of the present invention can also optionally contain water-soluble ethoxylated amines having clay soil removal and anti-redeposition properties. Liquid detergent compositions which contain these compounds typically contain from about 0.01% to 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986, incorporated herein by reference. Another group of preferred clay soil removal/anti-redeposition agents are the cationic compounds disclosed in European Patent Application 111,965, Oh and Gosselink, published Jun. 27, 1984, incorporated herein by reference. Other clay soil removal/anti-redeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985, all of which are incorporated herein by reference.

Other clay soil removal and/or anti redeposition agents known in the art can also be utilized in the compositions hereof. Another type of preferred anti-redeposition agent includes the carboxymethylcellulose (CMC) materials.

Polymeric Dispersing Agents

Polymeric dispersing agents can advantageously be utilized in the compositions hereof. These materials can aid in calcium and magnesium hardness control. Suitable polymeric dispersing agents include polymeric polycarboxylates and polyethylene glycols, although others known in the art can also be used.

Suitable polymeric dispersing agents for use herein are described in U.S. Pat. No. 3,308,067, Diehl, issued Mar. 7, 1967, and European Patent Application No. 66915, published Dec. 15, 1982, both incorporated herein by reference.

Brightener

Any suitable optical brighteners or other brightening or whitening agents known in the art can be incorporated into the detergent compositions hereof.

Commercial optical brighteners which may be useful in the present invention can be classified into subgroups which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982), the disclosure of which is incorporated herein by reference.

Suds Suppressor

Compounds known, or which become known, for reducing or suppressing the formation of suds can be incorporated into the compositions of the present invention. Suitable suds suppressors are described in Kirk Othmer Encyclopedia of Chemical Technology, Third Edition, Volume 7, pages 430–447 (John Wiley & Sons, Inc., 1979), U.S. Pat. No. 2,954,347, issued Sep. 27, 1960 to St. John, U.S. Pat. No. 4,265,779, issued May 5, 1981 to Gandolfo et al., U.S. Pat. No. 4,265,779, issued May 5, 1981 to Gandolfo et al. and European Patent Application No. 89307851.9, published Feb. 7, 1990, U.S. Pat. No. 3,455,839, German Patent Application DOS 2,124,526, U.S. Pat. No. 3,933,672, Bartolotta et al., and U.S. Pat. No. 4,652,392, Baginski et al., issued Mar. 24, 1987. All are incorporated herein by reference.

The compositions hereof will generally comprise from 0% to about 5% of suds suppressor.

Other Ingredients

In addition to the terpenes described above, the composition may also contain other perfume ingredients such as aldehydes, ketones, alcohols and esters. They have been described by Parry in Parry's *Cyclopedia of Perfumery* (1925) Vol. I and II, published by P. Blakiston's Son & Co.; and also by Bedoukian in *Perfumery and Flavoring Synthetics* (1967), published by Elsevier Publishing Company.

A wide variety of other ingredients useful in detergent compositions can be included in the compositions hereof, including other active ingredients, carriers, hydrotropes, processing aids, dyes or pigments, solvents for liquid formulations, bleaches, bleach activators, enzyme stabilizing systems, etc.

The laundry detergent compositions hereof preferably have a pH in a 10% solution in water at 20° C. of between about 5 and about 12, more preferably between about 8 and about 12 for granular compositions. They are preferably substantially free of potassium ions; sodium salts are preferred.

Liquid Compositions

Liquid detergent compositions herein can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., propylene glycol, ethylene glycol, glycerine, and 1,2-propanediol) can also be used.

Preferred liquid laundry detergent compositions hereof will preferably be formulated such that during use in aqueous cleaning operations, the wash water will have a pH of between about 6.5 and 11.0, preferably between about 7.0 and 8.5. The liquid detergent compositions herein preferably have a pH in a 10% solution in water at 20° C. of between about 6.5 and about 11.0, preferably about 7.0 to 8.5. Techniques for controlling pH at recommended usage levels include the use of buffers, alkalis, acids, etc., and are well known to those skilled in the art.

The following examples illustrate the compositions of the present invention. All parts, percentages and ratios used herein are by weight unless otherwise specified.

EXAMPLE I

A "fresh citrus" perfume is prepared using the following components:

| PERFUME A | % BY WEIGHT |
|---|---|
| Alpha terpineol | 1.80 |
| Citronellol | 1.50 |
| Citronellyl acetate | 1.08 |
| Geraniol | 1.26 |
| Isobornyl acetate | 1.08 |
| Linalool | 1.44 |
| Linalyl acetate | 2.10 |
| Camphene | 0.78 |
| Fenchyl acetate | 0.12 |
| Alpha pinene | 1.50 |
| Beta pinene | 1.08 |
| Citral | 2.40 |
| Citrathal | 0.74 |
| Citronellal nitrile | 0.84 |
| Dihydromyrcenol | 0.60 |
| Dipentene | 3.00 |
| Geranyl nitrile | 0.60 |
| Lemon oil | 0.30 |
| Orange oil 2× rectified | 2.40 |
| p-Cymene | 1.26 |
| Pseudo linalyl acetate | 1.20 |
| Terpene T | 0.18 |
| Other perfume components | 72.74 |
| | 100.00 |

Perfume A is used in the following concentrated heavy duty liquid detergent.

| INGREDIENTS | % BY WEIGHT |
|---|---|
| C14–15 alkyl polyethoxylate (2.25) sulfonic acid | 21.00 |
| C12–14 polyhydroxy fatty acide amide | 7.00 |
| Sodium tartrate mono-and di-succinate (80:20 mix) | 4.00 |
| Citric acid | 3.80 |
| C12–14 Fatty acid | 3.00 |
| Tetraethylene pentaamine ethyxylate (15–18) | 1.50 |
| Ethoxylated copolymer of polyethylene-polypropylene terephthalate polysulfonic acid | 0.20 |
| Protease (40 g/l)[1] | 1.38 |
| Brightener | 0.15 |
| Ethanol | 5.00 |
| Monoethanolamine | 3.50 |
| Sodium formate | 0.45 |
| 1,2 propane diol | 7.00 |
| Sodium hydroxide | 3.50 |
| Silicone suds suppressor | 0.04 |
| Boric acid | 2.00 |
| Lipase (100 KLU/g)[2] | 0.49 |
| Carezyme ®[3] | 0.14 |
| Perfume A, described above | 0.30 |

-continued

| INGREDIENTS | % BY WEIGHT |
|---|---|
| Water/miscellaneous | 35.55 |
| Total | 100.00 |
| pH (10% solution) | 7.8–8.3 |

[1]Modified bacterial serine protease described in European Patent Application Ser. No. 87 303761, filed April 28, 1987.
[2]Lipase obtained by cloning the gene from *Humicola lanuginosa* and expressing the gene in *Aspergillus oryzae* as described in European Patent Application 0 258 068 (commercially available under the trade name Lipolase from ex Novo Nordisk A/S, Copenhagen, Denmark).
[3]Commercially available cellulase from Novo Nordisk A/S Copenhagen.

Other compositions of the present invention are obtained when terpenes described in Perfume A are substituted with other terpenes at various levels within the scope of the invention. Non-terpene perfume components may also be included at various levels in these compositions.

EXAMPLE II

A citrus-floral perfume is prepared as shown below:

| PERFUME B | % BY WEIGHT |
|---|---|
| Geraniol | 30.0 |
| Citronellol | 25.0 |
| Linolool | 20.0 |
| d-Limonene | 15.0 |
| Myrcene | 5.0 |
| Dihydromyrcenol | 5.0 |
| | 100.0 |

This citrus-floral perfume is then incorporated in the following heavy duty liquid detergent:

| INGREDIENTS | % BY WEIGHT |
|---|---|
| C14–15 alkyl polyethoxylate (2.25) sulfonic acid | 8.43 |
| C12–13 alkyl ethoxylate | 3.37 |
| C12.3 linear alkylbenzene sulfonic acid | 8.43 |
| Dodecyl trimethyl ammonium chloride | 0.51 |
| Sodium tartrate mono-and di-succinate (80:20 mix) | 3.37 |
| Citric acid | 3.37 |
| C12–14 Fatty acid | 2.95 |
| Tetraethylene pentaamine ethyxylate (15–18) | 1.48 |
| Ethoxylated copolymer of polyethylene-polypropylene terephthalate polysulfonic acid | 0.20 |
| Protease (34 g/l)[1] | 0.52 |
| Brightener | 0.10 |
| Ethanol | 1.47 |
| Monoethanolamine | 1.05 |
| Sodium formate | 0.32 |
| 1,2 propane diol | 6.00 |
| Sodium hydroxide | 2.10 |
| Silicone suds suppressor | 0.0375 |
| Sodium cumene sulfonate | 3.00 |
| Boric acid | 2.00 |
| Lipase (100 KLU/g)[2] | 0.49 |
| Perfume B, described above | 0.20 |
| Water/miscellaneous | 50.6025 |
| Total | 100.00 |
| pH (10% solution) | 8.2–8.5 |

[1] and [2] see Example I

Other compositions of the present invention are obtained when terpenes described in Perfume B are substituted with other terpenes at various levels within the scope of the invention. Non-terpene perfume components may also be included at various levels in these compositions.

EXAMPLES III–VII

A floral perfume base is prepared as shown below and used in the preparation of Perfumes C, D, E, F and G.

| FLORAL BASE | |
|---|---|
| COMPONENT | % BY WEIGHT |
| Phenyl ethyl alcohol | 29.80 |
| P.T. bucinal | 15.00 |
| Tonalid | 15.00 |
| Dimetol | 10.00 |
| 4-Tertiary butyl cyclohexyl acetate | 15.00 |
| Galaxolide 50% | 10.00 |
| Dimethylbenzyl carbinyl acetate | 5.00 |
| Decyl aldehyde | 0.10 |
| Intreleven aldehyde | 0.10 |
| Total | 100.00 |

The following perfumes are prepared using the floral base by addition of the ingredients described below:

| | % BY WEIGHT |
|---|---|
| Perfume C | |
| Floral base | 50.0 |
| Citronellol | 10.0 |
| Citral | 25.0 |
| Linalool | 15.0 |
| Total | 100.0 |
| Perfume D | |
| Floral base | 70.0 |
| Linalool | 5.0 |
| Citronellol | 15.0 |
| Dihydromyrcenol | 9.8 |
| Alpha pinene | 0.1 |
| Beta pinene | 0.1 |
| Total | 100.0 |
| Perfume E | |
| Floral base | 80.0 |
| Geraniol | 4.9 |
| Linalool | 5.0 |
| Alpha pinene | 0.1 |
| D-limonene | 10.0 |
| Total | 100.0 |
| Perfume F | |
| Floral base | 90.0 |
| Geraniol | 4.0 |
| Myrcene | 5.0 |
| Citronellal | 1.0 |
| Total | 100.0 |
| Perfume G | |
| Floral base | 60.0 |
| Geraniol | 4.0 |
| Myrcene | 5.0 |
| Citronellol | 15.0 |
| Citronellal | 1.0 |
| Dihydrolinalool | 15.0 |
| Total | 100.0 |

An heavy duty liquid detergent base is prepared as shown below:

| INGREDIENTS | % BY WEIGHT |
|---|---|
| C14–15 Alkyl polyethoxylate (2.25) sulfonic acid | 10.60 |
| C12–13 Alkyl ethoxylate | 2.40 |
| C12.3 Linear alkylbenzene sulfonic acid | 12.50 |
| Sodium tartrate mono-and di-succinate (80:20 mix) | 6.00 |
| Citric acid | 4.00 |
| C12–14 Fatty acid | 2.00 |
| Tetraethylene pentaamine ethyxylate (15–18) | 1.50 |
| Ethoxylated copolymer of polyethylene-polypropylene terephthalate polysulfonic acid | 0.38 |
| Protease (34 g/l)[1] | 0.68 |
| Brightener | 0.15 |
| Ethanol | 1.47 |
| Monoethanolamine | 1.00 |
| Sodium formate | 0.32 |
| 1,2 propanediol | 6.00 |
| Sodium hydroxide | 3.10 |
| Silicone suds suppressor | 0.0375 |
| Sodium cumene sulfonate | 6.00 |
| Boric acid | 2.00 |
| Lipase (100 KLU/g)[2] | 0.48 |
| Perfume C, D, E, F or G | 0.25 |
| Water/miscellaneous | 38.8625 |
| Total | 100.00 |
| pH (10% solution) | 7.8–8.3 |

[1] and [2] see Example I

The perfumes C, D, E, F and G are incorporated in the above base matrix at the 0.25 weight % level.

Other compositions of the present invention are obtained when the terpenes in perfumes B, C, D, E and F are substituted with other terpenes at various levels within the scope of the invention. Non-terpene perfume components may also be included at various levels in this composition.

Lipase and proteases of the types and at the levels described herein above may also be substituted for the lipase and protease described in Examples I–VII. Cellulase and/or amylase at the levels described herein above may be added to these compositions.

EXAMPLE VIII

A condensed granular detergent base composition is made as shown below:

| INGREDIENT | % BY WEIGHT |
|---|---|
| C14–15 alkyl sulfonic acid | 13.00 |
| C14–15 alkyl ether (2.25) sulfonic acid | 5.50 |
| C12–13 alkyl polyethoxylate (6.5) | 1.45 |
| Polyhydroxy C12–14 fatty acid amide | 2.50 |
| Sodium aluminosilicate | 25.20 |
| Crystalline layered silicate builder | 23.30 |
| Citric acid | 10.00 |
| Sodium carbonate | 9.90 |
| To get wash pH | |
| Sodium polyacrylate (M.W. 2000) | 3.24 |
| Diethylenetriamine pentaacetic acid | 0.45 |
| Savinase ®[4] | 0.70 |
| 6 Nonoylamino 6 oxo peroxycaproic acid | 7.40 |
| Sodium perborate monohydrate | 2.10 |
| Nonyl oxybenzene sulfonic acid | 4.80 |
| Brightener | 0.10 |
| Perfume A or B described above | 0.30 |

-continued

| INGREDIENT | % BY WEIGHT |
|---|---|
| Lipase (100 KLU/g)[2] | 0.20 |
| | 100.00 |

[4]commercially available protease supplied by Novo Nordisk A/S Copenhagen

EXAMPLES IX–XI

An unfragranced heavy duty liquid detergent base is prepared as shown below:

| INGREDIENTS | % BY WEIGHT |
|---|---|
| C14–15 Alkyl polyethoxylate (2.25) sulfonic acid | 10.60 |
| C12–13 Alkyl ethoxylate | 2.40 |
| C12.3 Linear alkylbenzene sulfonic acid | 12.50 |
| Sodium tartrate mono-and di-succinate (80:20 mix) | 6.00 |
| Citric acid | 4.00 |
| C12–14 Fatty acid | 2.00 |
| Tetraethylene pentaamine ethyxylate (15–18) | 1.50 |
| Ethoxylated copolymer of polyethylene-polypropylene terephthalate polysulfonic acid | 0.38 |
| Protease (34 g/l)[1] | 0.68 |
| Brightener | 0.15 |
| Ethanol | 1.47 |
| Monoethanolamine | 1.00 |
| Sodium formate | 0.32 |
| 1,2 propanediol | 6.00 |
| Sodium hydroxide | 3.10 |
| Silicone suds suppressor | 0.0375 |
| Sodium cumene sulfonate | 6.00 |
| Boric acid | 2.00 |
| Ingredients described in Examples IX–XI | 1.00 |
| Water/misc. | 38.8625 |
| pH (10% solution) | 7.8–8.3 |

[1]This protease is the modified bacterial serine protease described in European Patent Application Ser. No. 87 303761, filed April 28, 1987.

This base is then used in the preparation of the compositions below.

| | Wt. % |
|---|---|
| Example IX | |
| Base Formula, described above | 99.00 |
| Perfume H (fresh, floral) | 0.25 |
| Water | 0.75 |
| Total | 100.00 |
| Example X | |
| Base Formula | 99.00 |
| Perfume H (fresh, floral) | 0.25 |
| Lipase (100 KLU/g)[2] | 0.48 |
| Water | 0.27 |
| Total | 100.00 |
| Example XI | |
| Base Formula | 99.00 |
| Perfume I (fruity, floral, green) | 0.25 |
| Lipase (100 KLU/g)[2] | 0.48 |
| Water | 0.27 |
| Total | 100.00 |

[2]This lipase is obtained by cloning the gene from *Humicola lanuginosa* and expressing the gene in *Aspergillus oryzae* as described in European Patent Application 0 258 068. It is commercially available under the trade name Lipolase (ex Novo Nordisk A/S, Copenhagen Denmark).

The liquid detergents in Examples IX–XI are used in washing soiled test fabrics (kitchen towels and T-shirts). The washed garments are stored at room temperature and sniffed for the incidence of malodor by an expert perfumer. The odor on wet and dry fabric is described in Table 3.

TABLE 3

| | Odor Description | | |
|---|---|---|---|
| | Example IX | Example X | Example XI |
| Wet | floral | floral, with | fruity |
| | fresh | slight sour note | floral |
| Dry | floral | sour, musty | fruity |
| fabric | fresh | butyric odor | floral |

Conclusions

The data indicate that the liquid detergent composition, in the absence of lipase, does not produce objectionable odor on the fabric (Example IX). Example X shows that incorporation of lipase in the formulation results in a characteristic butyric, sour odor. The detergent composition with Perfume H containing negligible levels of terpenes is not effective in eliminating this odor. A detergent composition containing Perfume I on the other hand which contains myrcene, dihydromyrcenol, linalool and limonene in the head-space is effective in eliminating the foul odor (Example XI). This is surprising because it was believed that these compounds, being low boiling, are not retained by the fabric past the drier stage. The perfume ingredients deposited on the fabric are extracted and analyzed by gas chromatography/mass spectrometry using standard analytical techniques for head-space analysis. The relative composition of the perfume ingredients in the head-space is shown in Table 4. Table 4 also lists the relative threshold concentration for olfactory detection. A low critical threshold indicates that these compounds are detectable by human nose at a low concentration. In other words, the nose is more sensitive to these components with a low threshold.

TABLE 4

| Relative abundances of perfume components in head-space | | | | |
|---|---|---|---|---|
| Component | Rel. Olfactory Threshold | EX IX | EX X | EX XI |
| Myrcene | high | N/A | N/A | 6 |
| D-Limonene | low | 100 | 85 | 84 |
| Dihydromyrcenol | high | nd | nd | 4 |
| Linalool | high | nd | 3 | 14 |
| Phenyl ethyl alcohol | high | nd | 12 | 3 |
| Benzyl acetate | | nd | 17 | 3 |

nd = none detected

What is claimed is:

1. A laundry detergent composition comprising:

(a) from about 0.0005% to about 1.0% of an active basis of a detergent-compatible lipase that catalyzes hydrolysis of triglycerides on soiled fabrics laundered in washing solutions prepared from said composition, to thereby form free fatty acids;

(b) from about 0,005% to 1.0%, by weight of the composition, of a perfume ingredient selected from the group consisting of Perfume A which consists essentially of alpha terpineol, citronellol, citronellyl acetate, geraniol, isobornyl acetate, linalool, linalyl acetate, camphene, fenchyl acetate, alpha pinene, beta pinene, citral, citrathal, citronellal nitrile, dihydromycernol, dipentene, geranyl nitrile, lemon oil, orange oil, paracymene, pseudo linalyl acetate, and Terpene T; Perfume B which consists essentially of geraniol, citronellol, linolool, d-limonene, myrcene, and dihydromyrcenol; Perfume C which consists essentially of phenyl ethyl alcohol, bucinal, tonalid, dimetol, 4-Tertiary butyl cyclohexyl acetate, Galoxide 50%, dimethylbenzyl carbinal acetate, decyl aidehyde, Intreleven aldehyde and mixtures thereof;

(c) from about 1 to 95% of a detersive surfactant selected from the group consisting of anionic, nonionic, ampholytic, cationic, zwitterionic, and mixtures thereof.

2. A composition according to claim 1 further comprising a performance-enhancing amount of a detergent-compatible second enzyme selected from the group consisting of protease, amylase, cellulase, peroxidase, and mixtures thereof.

3. A composition according to claim 1 further comprising from about 0.0001 to 1.0% on an active enzyme basis of detergent-compatible protease.

4. A composition according to claim 1 comprising from about 5 to 50% weight of anionic or nonionic surfactant or mixtures thereof.

5. A composition according to claim 4 having a pH in a 10% solution in water at 20° C. of between about 5 and 12.

6. A composition according to claim 5 further comprising from about 1 to about 80% of detergency builder.

7. A composition according to claim 3 wherein said protease comprises from about 0.0005 to 0.5% of active protease selected from the group consisting of modified bacterial serine proteolytic enzymes and mixtures thereof.

8. A composition according to claim 1 further comprising from about 0.0001 to 1.0% on an active enzyme basis of detergent-compatible amylase or cellulase.

9. A composition according to claim 7 comprising from about 2 to about 20,000 lipase units per gram of lipase producible by Pseudomonas or Humicola.

10. A composition according to claim 8 which is a granular laundry detergent and which provides a pH in a 10% solution in water between about 8 and about 12.

11. A composition according to claim 1 which is a liquid laundry detergent and which comprises from about 10 to about 6,000 lipase units per gram of lipase obtained by cloning the gene from *Humicola lanuginosa* and expressing the gene in *Aspergillus oryzae*.

12. A liquid detergent composition according to claim 11 with a pH in a 10% solution in water between about 6.5 and about 11.

13. A liquid detergent composition according to claim 12 comprising from about 10 to about 30 weight % of a surfactant selected from the group consisting of $C_{12}$–$C_{20}$ alkyl sulfates, $C_{12}$–$C_{20}$ alkyl ether sulfates, $C_9$–$C_{20}$ linear alkylbenzene sulfonates, and the condensation products of $C_{10}$–$C_{20}$ alcohol with between about 2 and 20 moles of ethylene oxide per mole of alcohol.

14. A liquid detergent composition according to claim 12 comprising from about 3% to about 30% of polyhydroxy fatty acid amide surfactant.

* * * * *